US005376921A

United States Patent [19]

Trikilis

[11] Patent Number: 5,376,921

[45] Date of Patent: Dec. 27, 1994

[54] SECURITY SYSTEM EMPLOYING MAGNETIZATION AND DETECTION

[76] Inventor: Emmanuel M. Trikilis, 1545 W. 130th St., Brunswick, Ohio 44212

[21] Appl. No.: 983,401

[22] Filed: Nov. 30, 1992

[51] Int. Cl.[5] ..... G08B 13/22

[52] U.S. Cl. ..... 340/551; 335/284; 335/306; 340/568; 340/825.32

[58] Field of Search ..... 340/551, 568, 572, 825.32, 340/825.31; 335/284, 306

[56] References Cited

U.S. PATENT DOCUMENTS 3,701,100 10/1972 Yarbrough ..... 340/825.31

*Primary Examiner*—Glen Swann

*Attorney, Agent, or Firm*—Fay, Sharpe, Beall, Fagan, Minnich & McKee

[57] ABSTRACT

A security system includes a magnet having a high magnetic field strength and wide flux area. Individuals seeking to enter or leave a secure area are directed so as to be in relatively close physical proximity to the magnet. Hard or soft ferrous material on the individual, which would be included in any items likely to be pilfered, are magnetized sufficient to generate a signal to a magnetometer, to which the individuals are proximately directed after passing the magnet. Detection of a magnetized, ferrous substance in the magnetometer causes the locking of a turnstile, forcing the individual to a secondary area. A magnetic card, unique to an individual, can also be utilized to facilitate identification of an individual prior to entry to the system, as well as to catalogue security breaches and ingress/egress times.

20 Claims, 5 Drawing Sheets

SECURITY SYSTEM EMPLOYING MAGNETIZATION AND DETECTION

BACKGROUND OF THE INVENTION

This application pertains to the art of security systems and more particularly to security systems to prevent pilferage or entry of persons carrying prohibited materials. The invention is particularly applicable to employee plant entry and exiting and will be described with particular reference thereto. However, it will also be appreciated that the invention has broader application such as in airport security, retail sales, or any area in which restricted personnel access is advantageous.

A significant amount of productivity and profitability is lost by businesses each year due to employee pilferage. The traditional way of lessening such pilferage is with security guards working at plant entrance and exit checkpoints. While security guards are of some benefit, they leave substantial possibility for theft. The volume of employees through a checkpoint, especially during shift changes, coupled with an ability to conceal objects, makes it very difficult for security guards to prevent theft.

An earlier generation of theft detection systems was provided in U.S. Pat. No. 3,292,080 entitled "System and Method for Preventing Pilferage by Detection of Magnetic Fields" and U.S. Pat. No. 3,896,372 entitled "Magnetic Sensing Detection System and Method". Both of these patents were developed by the inventor hereof and both disclose systems for preventing pilferage. They utilized a magnet for magnetizing hard ferrous material on the person of the employee. While effective, the systems were limited in the types ferrous materials which were detectable. The systems also provided bottlenecks to traffic flow in high traffic areas or during high traffic periods. This problem was exacerbated when the normal traffic flow was interrupted due to a detected pilferage. Finally, the systems were unidirectional or required expensively duplicative hardware to accomplish employee checks during entry or exit from a plant. Thus while library pilferage and the like has been greatly decreased by my earlier developed systems, such systems were not in use in the manufacturing and warehousing environment.

The present invention contemplates a new and improved security system which overcomes all of the above-referred problems, and others, and provides a system which is more accurate, versatile and economical.

SUMMARY OF THE INVENTION

In accordance with the present invention there is provided a detection system which employs an identification card ("ID") card reader which is disposed at an entrance way prior to access to the secondary or secured area. A barrier directs individuals to an area approximate to a magnet. The magnet includes multiple, similarly-polarized magnet portions separated, by nonferrous spacers. This orientation provides a sufficiently high magnetic field strength and flux coverage to expose the entire individual to a sufficient magnetic flux field to affect both hard-ferrous, as well as soft-ferrous materials. After exposure to the magnetic field, the individuals are directed, via the barrier means, to a magnetic sensor. The sensor detects the presence of ferrous material as magnetized by the magnet. Detection of a ferrous material disables a turnstile, thus precluding entry to the secondary or secured area while advantageously directing the associated individual to a special area to avoid interrupting traffic flow.

In accordance with a more limited aspect of the present invention, an alarm signal is generated upon detection of a magnetized substance to alert appropriate personnel.

In accordance with another aspect of the present invention, a second ID card reader, a second magnet, and a second sensor, similar to the other sensor, are disposed in the second area. These function in concert with the barrier and the turnstile to regulate traffic flow in the opposite direction.

In accordance with yet another aspect of the present invention, the first ID card reader, first magnet, and first sensor are mounted on a base plate so as to be pivotable to accommodate traffic flow in a selected direction.

An advantage of the present invention is the provision of a security system with increased sensitivity to soft-ferrous materials.

Another advantage of the present invention is the provision of a magnetization and detection system which eliminates traffic bottlenecks, particularly when an object has been detected, by not interrupting traffic flow and directing a particular individual to a specified area.

Still a further advantage of the present invention is the provision of a magnetization and detection system which uses less hardware, thereby being less costly, than earlier automated systems.

Yet a further advantage of the present invention is the provision of a theft detection system which may function with or without human security personnel.

Yet still a further advantage of the present invention is a security system that provides for automated data acquisition of security breaches or entry and exit times unique to an employee.

Further advantages will become apparent to one of ordinary skill in the art upon the reading and understanding the subject specification.

BRIEF DESCRIPTION OF THE DRAWINGS

The invention may take physical form in certain parts, and arrangements of parts, several embodiments of which will be described in detail in this specification and illustrated in the accompanying drawings which form a part hereof and wherein.

DETAILED DESCRIPTION OF THE PREFERRED AND ALTERNATE EMBODIMENTS

Figure 1:
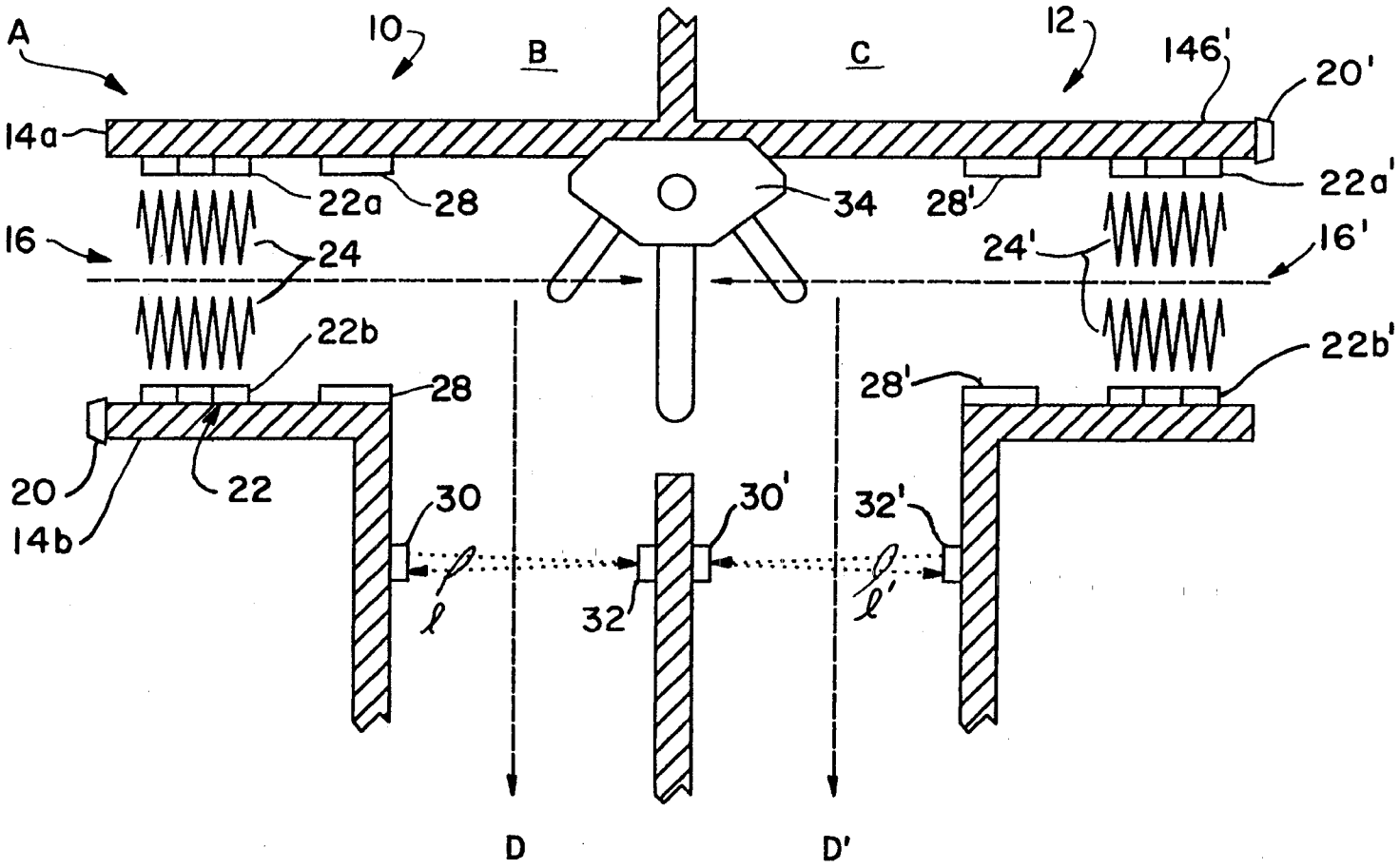
FIG. 1 illustrates an overhead view of a first embodiment of the detection system of the present invention.

Referring now to the drawings wherein the showings are for the purposes of illustrating the several embodiments of the invention only and not for the purposes of limiting the same, FIG. 1 illustrates a magnetically sensitized object detection system A which regulates access between a first area B and a second area C. Presence of an object which triggers the detection system A, as will be described further below, forces diversion of a person into an area D, or D', depending on a direction of traffic flow.

The system A includes a first portion 10 and a second portion 12, each of which provide similar functions depending on traffic flow from first area B to second area C or from second area C to first area B. With this arrangement, the system advantageously allows for monitoring individuals as they enter or leave a particular facility while using less floor space and reduced equipment duplication. Turning first to the first portion 10, included is a barrier comprised of a first portion 14*a* and a second portion 14*b*. The portions 14*a* and 14*b* define an entry 16. Secured to the barrier portion 14*b*, at entry 16, is an identification ("ID") card reader 20. A suitable reader for the ID card reader 20 utilizes a barrier-specific indicia, such as an employee identification card or tag. While there are many conventionally available ID card readers which are suitable for implementation, those which do not employ magnetic stripes or magnetically sensitive regions may be advantageous due to magnetic field exposure, as will be described further below. Such suitable, card systems may employ optical indicia, semi-conductor memory, or the like.

In the preferred embodiment, the ID card reader serves to identify the employee or other person seeking entry to a secured area (or exit therefrom), as well as providing a log as to employee hours which may displace or supplement a conventional time card. Suitable systems are commercially available and well within the understanding of one ordinary skill in the art. The use of such an identification further advantageously allows for a written record of any employee who triggers the security system. A historic record of security breaches associated with a particular employee provides a tangible record for further investigation or discipline.

Disposed after the entry 16, between the portions 14*a* and 14*b*, is a magnet arrangement or means 22. The particular fabrication of the magnets 22 is chosen so as to maximize the flux density and field area between respective portions 22*a* and 22*b*, as is illustrated by a magnetic field area 24. A detailed description of embodiments of the magnet 22 will be described further below.

A person passing through magnetic field area 24 is exposed to a magnetic field of a significant and sufficient flux density to cause magnetization of ferrous material on their person. A person passing through magnetic field area 24 quickly progresses to a magnetometer or sensor means 28. The magnetometer 28 is sufficiently sensitive to detect ferrous objects which have been magnetized by virtue of their exposure to the magnetic field in area 24. The combination of the relative magnetic field strength and proximity of the magnet 22 to the magnetometer 28 allows for detection of both hard-ferrous materials, which dissipate a magnetic field slowly, and soft-ferrous materials, which dissipate a magnetic field rapidly.

It should also be noted that most personal items, likely to be carried by a person passing through the system, will be neither adversely magnetized nor trigger a false alarm. For example, most surgical metallic implants are formed of non-magnetic stainless steel. Also, most jewelry is made of gold, silver, platinum or the like and will not be magnetized. In addition, most coins, wristwatches, keys, and the like are also made from non-magnetizable materials such as aluminum and brass.

Magnetometers suitable to accomplish such detection are commercially available and well within the understanding of one of ordinary skill in the art. Particular data flow and control logic associated with the magnetometer are detailed below.

Upon detection of a magnetized, ferrous material with magnetometer 28, a signal is generated which is representative of the presence of a suspect material on the person passing through the system. This signal serves to cause a lock of a turnstile 34, precluding progress from first area B to second area C. The turnstile 34 is set to be ratcheted to allow progress only from area B to area C, even in the absence of such a signal.

By virtue of the above-described structure, a detected ferrous substance forces an individual to divert to the area D. The area D may be to security personnel, or to another area, such as a waiting area or return to the first area B to allow removal of the suspect object. In this way, progress is not interrupted or impeded for a stream of individuals following the person who triggered the detection system.

The detection system A advantageously includes structure to determine that a person triggering a detection signal progresses to area D before re-enabling the turnstile 34. This is accomplished with a proximity detector, suitably formed from a conventional photoelectric sensor. This includes a beam generator/detector 30 which projects a beam 1 to reflector 32, which in turn, reflects the beam thereto. This provides a reset signal by a person breaking beam 1. Thus, the turnstile 34 may remain locked until the person triggering the detection system moves to area D. Although a photodetector has been illustrated, it will be appreciated that other proximity sensors such as footpads, acoustic sensors, etc. could also be provided.

Turning now to the second portion 12, it will be seen that complimentary structure to that provided in first portion 10 is provided. Similar structure has been provided similar reference numerals which have been primed (') for distinction. It will be appreciated that each constituent of this structure functions analogously to its counterpart, described above.

The orientations of the respective structures of first portion 10 and second portion 12, inclusive of structure shared there between, provides for a minimization of space necessary for the security system, as well as avoiding certain duplicated hardware, such as the turnstile 34. It will be appreciated that when the system is utilized to monitor or regulate progress from secondary area C to first area B, the turnstile 34 is ratcheted for passage in the direction opposite to that described above, unless impeded from a signal resultant from a detected, suspect object.

The alternative directional orientation of the embodiment of FIG. 1 provides further advantages. When the system A is disposed in a manufacturing location, employees may be checked for personal items prior to their entry to the premises. In this way, these items, which could cause concern when exiting the location, can be detected and stored prior to access to the premises. Further, removal of ferrous property from the premises is precluded.

When the system is used in conjunction with industries employing non-ferrous products, such as in the clothing industry, an alternative and effective adjunct is provided. In this situation, a garment or package, such as a blister package, may be simply and inexpensively fabricated to include a small amount of magnetic material. Such a small amount of magnetic material, even less than 0.005 inches thick, e.g. in the shape of a label or the like and with an adhesive backing to secure it in place, would be sufficient to react with the magnetic field of the subject system and trigger a detection. Two type of targets are contemplated, a temporary target or a permanent target. A temporary target would absorb a high magnetic field which would dissipate over 3 to 4 hours. Such a target, which could be made from a soft ferrous material with no carbon, can charge to e.g. 9,000 to 10,000 gauss. A more permanent magnetic-retaining substance is suitably provided by a ferrous material high in carbon and having about a 50 Rockwell hardness. Such a material typically retains 90% of an induced field thereon for a usable period of time.

A permanent magnetic target could be magnetized as the item is being manufactured or before the item is sent from a factory to a warehouse, if warehouse pilferage is the problem. On the other hand, a temporary magnetic target would need to be magnetized at the time of egress when pilferage is anticipated, as is done in the apparatus of FIG. 1. Such an item could, of course, be remagnetized if necessary.

Figure 2:
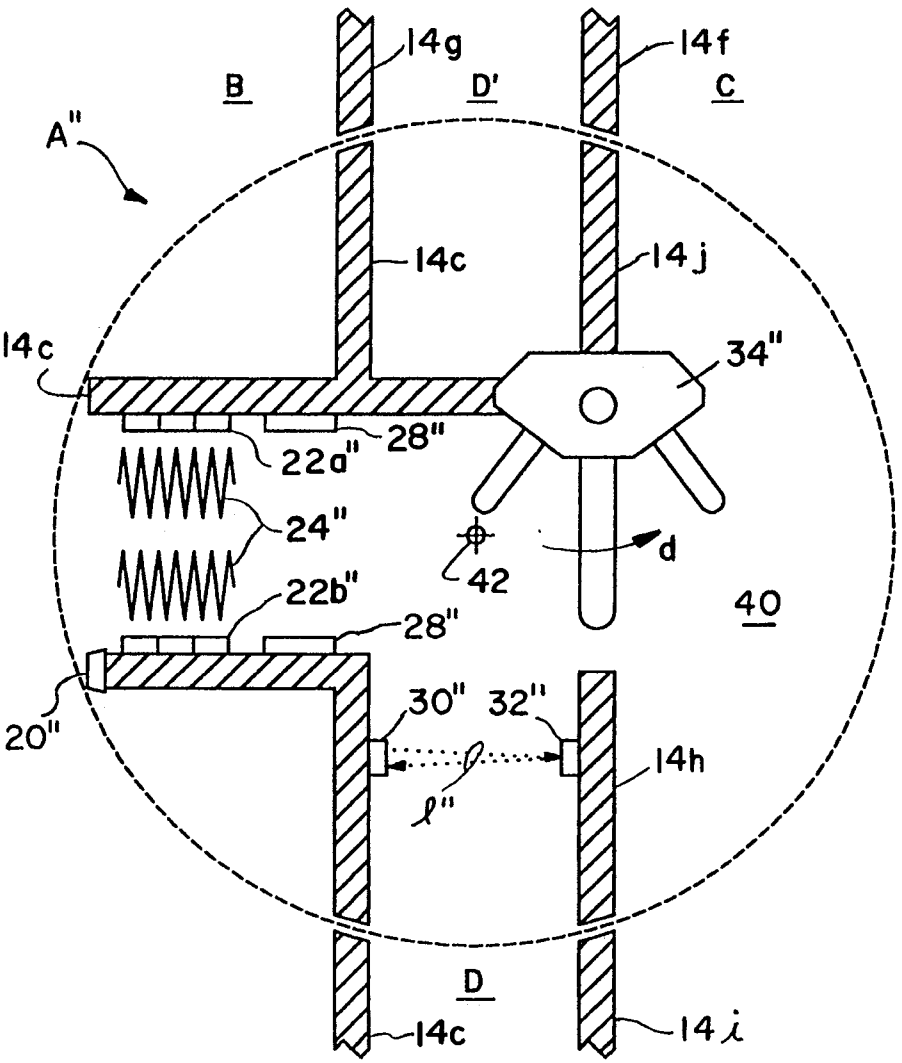
FIG. 2 illustrates an overhead view of an alternative embodiment of the detection system of the present invention.

Turning now to FIG. 2, an alternative embodiment of the security system of FIG. 1 will be described. Depicted therein is a system which provides even more efficient utilization of structure and floor space to accomplish alternative flow control between areas B and C. Similar structure has been numbered with a double primed (″) suffix to correspond to that described above. Since such structure functions analogously, it will not be described further herein.

The system A″ of FIG. 2 utilizes a single magnet 22*a*″ and 22*b*″ as well as a single magnetometer 28″. Accordingly, fabrication costs are lessened by avoiding additional, redundant structure. As will be noted from the illustration, the structure of the unit has been selectively incorporated onto a rotatable floor plate 40, adapted to pivot about an axis point 42. As pictured, the system is set up for regulating access from area B to area C. Detection of a suspected object causes locking of turnstile 34″, which may, in this embodiment be permanently ratcheted for motion in the direction d, unless disabled as noted above. When flow is from area C to area B, the plate 40 is pivoted about axis point 42 so that portion 14*h* abuts portion 14*g*. Correspondingly, a leg of portion 14*c* abuts portion 14*i* and portion 14*e* abuts portion 14*j*. When so counter disposed, triggering of the detection mechanism by a suspected object forces a diversion to area D′.

Figure 3:
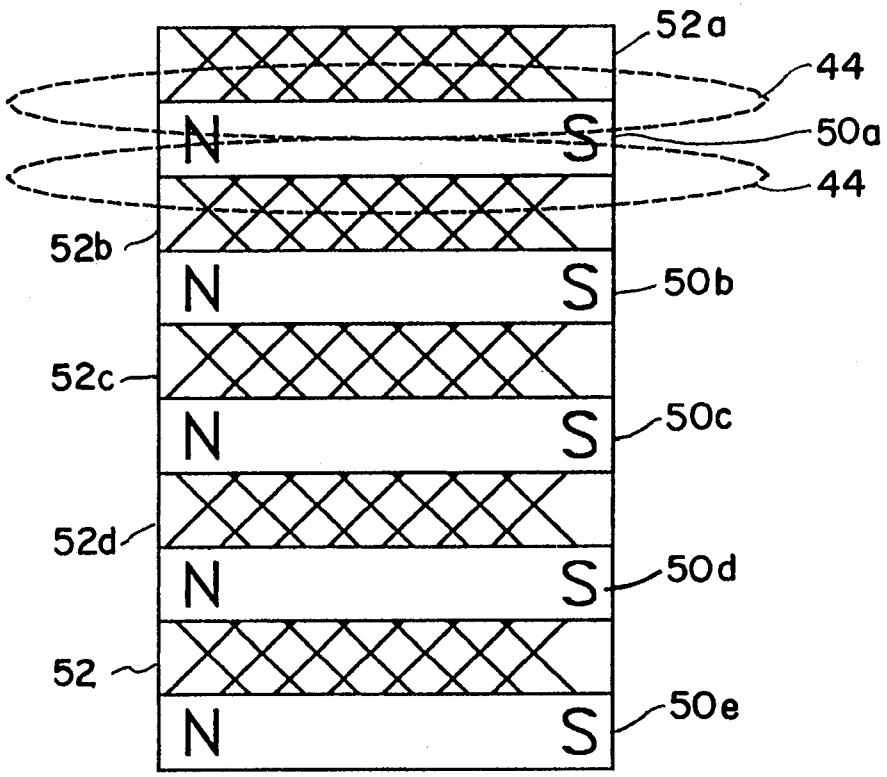
FIG. 3 illustrates a first embodiment, employing fixed magnets, of a magnetization sub-system of FIGS. 1 or 2.

Turning now to FIG. 3, a first embodiment of magnet 22 will be described. In this embodiment, a plurality of fixed suitable conventional magnets, oriented in a similar polarity, are utilized. Five such magnets, 50*a*–50*e* are illustrated. However, it will be appreciated that fewer or more magnets may be utilized in connection with the area to be magnetized, depending on the desired field strength of the magnetization area, as well as the size and strength of the fixed magnets themselves. The fixed magnets are separated from each other by layers of a suitable conventional non-ferrous separator material, illustrated as portions 52*a*–*e*. Separation of the magnets by the non-ferrous material advantageously provides an increased area of magnetic flux coverage, illustrated by continuous flux line 44 associated with magnet 50*a*. The flux lines of each magnet 50 additively form the magnetic field area 24 (FIGS. 1 and 2).

Figure 4:
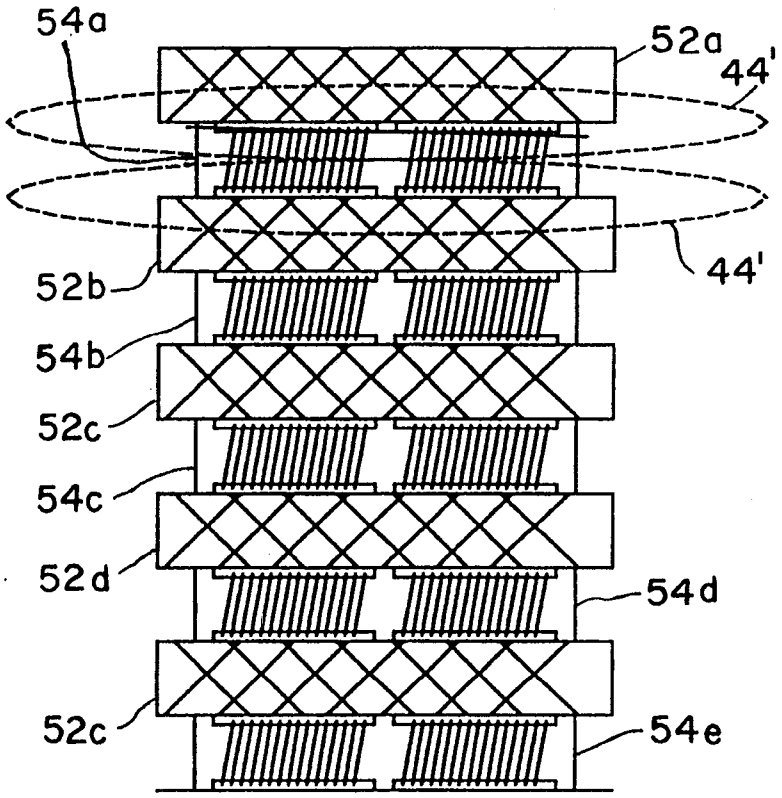
FIG. 4 illustrates a second embodiment of a magnet system, employing electromagnets, for use in the systems of FIGS. 1 or 2.

Turning now to FIG. 4, a variation of the magnet of FIG. 3, employing electromagnets, is illustrated. Therein, the permanent magnets 50 of FIG. 3 have been replaced with electromagnets, illustrated as 54*a*–54*e*, respectively. Again, it will be appreciated that more or fewer electromagnets may be substituted for the reasons noted earlier. However, the strength of the electromagnets 52 is dictated by current flow and a number of windings associated with each of the electromagnetic portions 54. Accordingly, this embodiment facilitates selective operation of the magnet, as well as control of field strength thereof.

Figure 5:
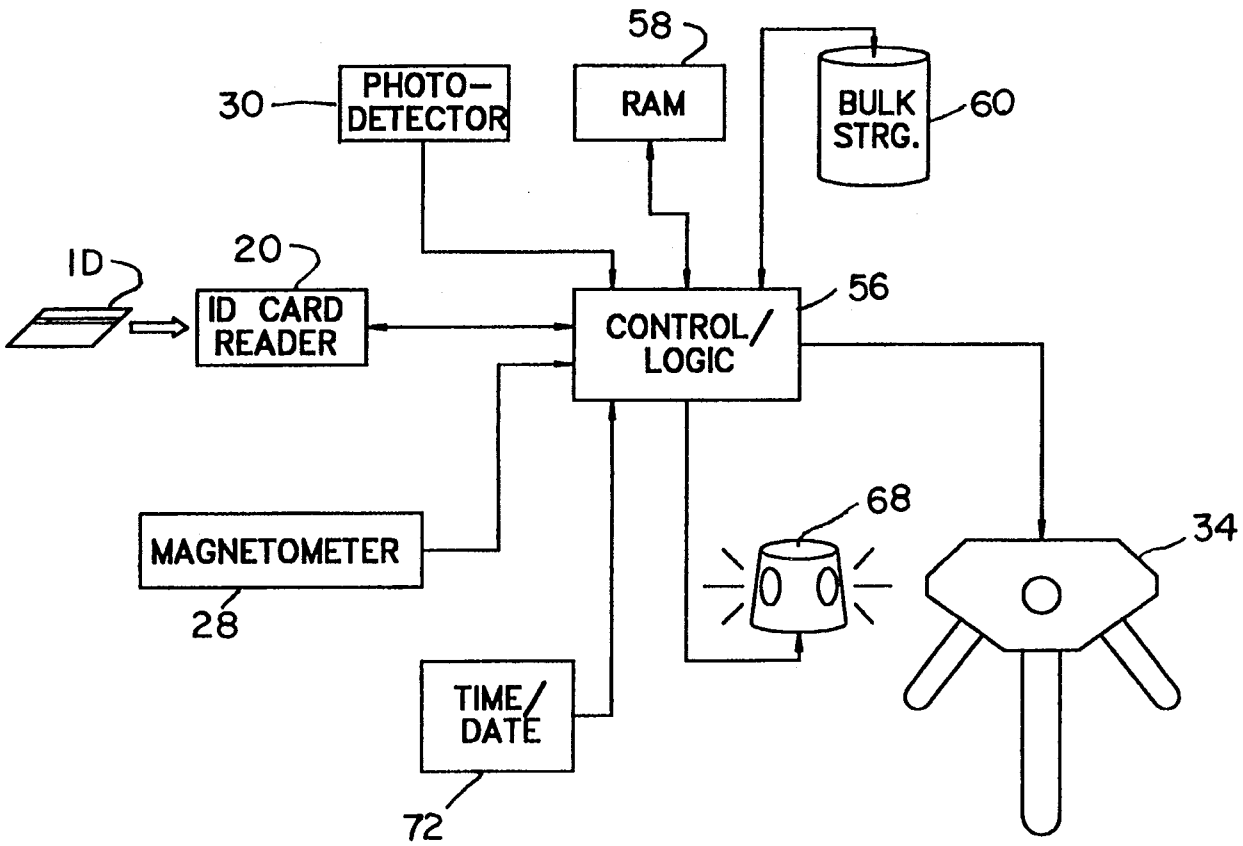
FIG. 5 illustrates a block diagram of the identification, detection data processing, archiving, and control logic of the subject invention; and, FIG. 6 illustrates, in flow chart form, the decision blocks associated with operation of the subject system.

Turning now to FIG. 5, a block diagram of the interconnections evidencing data and control flow between components of the system of FIGS. 1 and 2 will be described. It will be seen that the I.D. card reader 20 is adapted to receive a card ID. The card ID bears information concerning the employee's identification, security level, and the like. In addition to logging in entry and exit time of an employee, the information associated with system object detection may be tracked for a particular employee. Identification cards suitably also allow for specified individual rights to pass certain materials through the system which would otherwise result in a triggering. Finally, the card may also include indicia which disables the system magnetization, particularly in a system which utilizes electromagnets such as that described in FIG. 4. This would allow selective passing of magnetically sensitized materials, such as magnetic data storage medium, which would otherwise be damaged by exposure to the magnetic field.

The ID card reader 20, as well as magnetometer 28 and photodetector 30, are interfaced in data communication with a control/logic system, evidenced by block 56. The control/logic block 56 is suitably formed from conventional, general-purpose data acquisition and process control hardware. The illustrated system utilizes a random access memory (RAM) for program or data storage and a bulk or nonvolatile memory 60, such as a hard disk. The system also advantageously employs a clock/calendar circuit 72 to allow for historic capture and archiving of event data.

The control/logic unit 56 is in signal communication with both the turnstile 34 and an alarm signal unit 68. As noted above, the turnstile 34 has adapted to being disabled, thus precluding motion therethrough, upon receipt of an appropriate signal, supplied from control/logic unit 56.

Further, particularly in the embodiment of FIG. 1, the turnstile 34 is selectively ratchetable for passage in a single direction only, unless disabled by application of an appropriate signal from unit 56.

The alarm signal unit 68 is advantageously implemented to notify the appropriate personnel when a security breach has been realized. This alarm is suitably audible, visible, or both. However, it will be appreciated that a silent alarm may also be advantageously implemented in certain situations.

Figure 6:
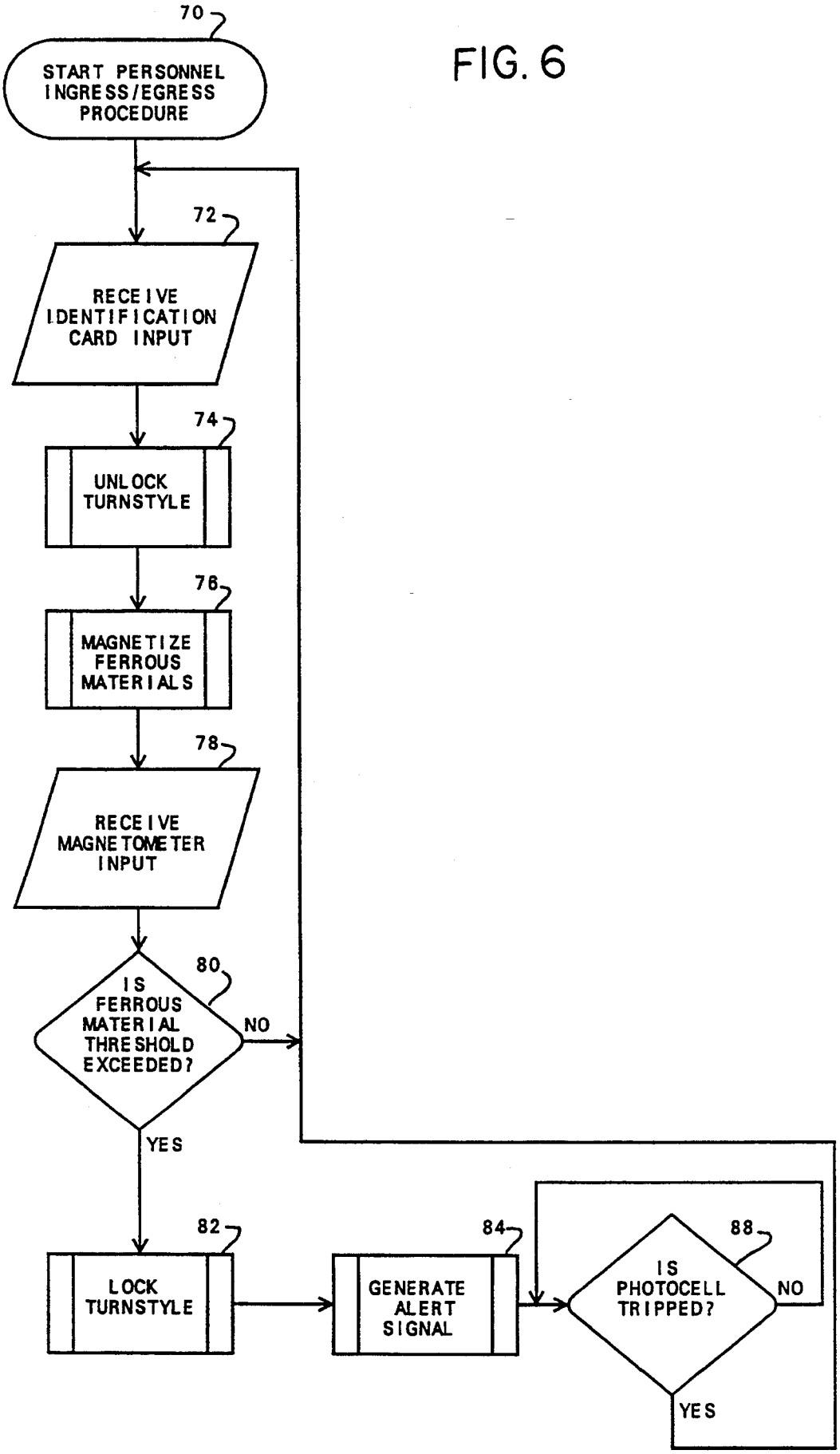

Turning now to FIG. 6, a flow chart for the control/-logic circuitry 56 of FIG. 5 is provided. When the system is active, the monitoring is accomplished in a looping fashion as illustrated by the Figure. At block 70, the procedure is commenced in accordance with personnel ingress/egress. The system moves to block 72, at which point it receives data from the ID card associated with a particular individual. The turnstile is unlocked in block 74. At block 76, magnetization of ferrous materials on the person is completed. At block 78, the system receives data representative of such ferrous materials. At block 80, a test of the signal is made against a preselected threshold level to determine if a system security breach is present. If so, the system progresses to block 82, thus locking the turnstile. At block 84, an appropriate signal is generated representative of the security breach. The person is then forced to exit the normal pathway for the reasons noted above. The system enters a loop at block 88, precluding passage of any person through the turnstile 34 until the photocell 30 has been tripped by passage of the individual who triggered the alarm into area D. The system proceeds again to block 72, at which point information representative of the next employee is received. This looping is continued. This provides the security with minimized traffic flow interruption noted above.

While the passage control means of the preferred embodiment is illustrated as a turnstile in FIGS. 1, 2 and 5, it should be appreciated that other types of passage control members could also be provided if desired. For example one could use revolving doors instead of turnstiles with the present invention. In addition, while a specific type of turnstile is illustrated in the drawings many other conventional varieties of turnstiles could also be used with the present invention.

This invention has been described with reference to the preferred and alternate embodiments. Obviously, modifications and alterations will occur to others upon reading and understanding of this specification. It is intended that all such modifications and alterations be included insofar as they come within the scope of the appended claims or the equivalents thereof.

Having thus described the invention it is now claimed:

1. A magnetically sensitized object detection system for controlling access between source and destination areas comprising:

magnet means, disposed in the source area, for generating a magnetic field, wherein the magnet means includes, a plurality of magnets, oriented such that their respective magnetic fields are functionally additively oriented, and a plurality of non-ferrous spacers disposed between the magnets;

barrier means for directing a person to walk in close physical proximity to the magnet means, whereby the person is exposed to a significant magnetic flux level of the magnetic field;

sensor means in the source area for sensing a ferrous material after exposure to the magnetic field, the sensor means including means for generating a trigger signal representative of the presence of a ferrous material;

means for generating an alert signal responsive to the trigger signal;

passage control means for selectively permitting passage from the source area to the destination area; and means for selectively locking the passage control means responsive to the trigger signal.

2. The magnetically sensitized object detection system of claim 1 wherein the barrier means includes means for allowing passage from the source area to an alternative area when the passage control means is locked.

3. The magnetically sensitized object detection system of claim 2 wherein at least one of the plurality of magnets is an electromagnetic.

4. The magnetically sensitized object detection system of claim 2 further comprising:

means for generating a proximity signal representative of passage of a person from the source area to the alternative area; and means for unlocking the passage control means responsive to the proximity signal.

5. A magnetically sensitized object detection system for controlling access between source and destination areas comprising:

first magnet means, disposed in the source area, for generating a magnetic field in the source area;

barrier means for directing a person to walk in close physical proximity to the first magnet means, whereby the person is exposed to a significant magnetic flux level of the magnetic field;

source area sensor means in the source area for sensing a ferrous material after exposure to the magnetic field in the source area, the sensor means including means for generating a source area trigger signal representative of the presence of a ferrous material;

means for generating an alert signal responsive to the source area trigger signal;

passage control means for selectively permitting passage from the source area to the destination area;

means for selectively locking the passage control means responsive to the source area trigger signal;

second magnet means for generating a destination area magnetic field;

the barrier means including means for directing a person to walk in close physical proximity to the second magnet means, whereby the person is exposed to a significant magnetic flux level of the magnetic field in the destination area;

the passage control means including means for selectively permitting passage from the destination area to the source area;

destination area sensor means in the destination area for sensing a ferrous material after exposure to the magnetic field in destination area, the destination area sensor means including means for generating a destination area trigger signal representative of the presence of a ferrous material in the destination area;

means for generating an alert signal responsive to the trigger signal; and means for locking the passage control means responsive to the destination area trigger signal, wherein each of the magnet means includes, a plurality of magnets, oriented such that their respective magnetic fields are functionally additively oriented, and a plurality of non-ferrous spacers disposed between the magnets.

6. A magnetically sensitized object detection system for controlling access between source and destination areas comprising:

a base plate;

magnet means, disposed in the source area, for generating a magnetic field;

barrier means for directing a person no walk in close physical proximity to the magnet means, whereby the person is exposed to a significant magnetic flux level of the magnetic field in the source area;

sensor means in the source area for sensing a ferrous material after exposure to the magnetic field, the sensor means including means for generating a trigger signal representative of the presence of a ferrous material;

means for generating an alert signal responsive to the trigger signal;

passage control means for selectively permitting passage from the source area to the destination area; and means for selectively locking the passage control means responsive to the trigger signal, wherein the magnet means, the barrier means, the passage control means, and the sensor means are secured to the base plate such that the system is adapted to be pivoted on the base plate whereby the source and destination areas are interchanged.

7. The magnetically sensitized object detection system of claim 6 wherein the magnet means includes:

a plurality of magnets, oriented such that their respective magnetic fields are functionally additively oriented; and a plurality of non-ferrous spacers disposed between the magnets.

8. A magnetically sensitized object detection system for controlling access between source and destination areas comprising:

magnet means, disposed in the source area, for generating a magnetic field, the magnet means including a first plurality of magnets, oriented such that their respective magnetic fields are functionally additively oriented, and a plurality of non-ferrous spacers disposed between the magnets;

first barrier means for directing a person to walk in close physical proximity to the magnet means, whereby the person is exposed to a significant magnetic flux level of the magnetic field;

sensor means in the source area for sensing a ferrous material after exposure to the magnetic field, the sensor means including means for generating a trigger signal representative of the presence of a ferrous material;

alert signal generating means for generating an alert signal responsive to the trigger signal;

passage control means for selectively permitting passage from the source area to the destination area;

control means for locking the passage control means responsive to the trigger signal; and second barrier means for directing a person to walk from the source area to an alternative area when the passage control means is locked.

9. The magnetically sensitized object detection system of claim 8 further comprising:

identification card means, disposed in the source area, for reading employee data from an identification card; and means for selectively locking the passage control means responsive to the employee data.

10. The magnetically sensitized object detection system of claim 9 further comprising:

means for selectively disabling the alert signal generating means responsive to the employee data.

11. The magnetically sensitized object detection system of claim 10 wherein:

at least one of the plurality of magnets is an electromagnet; and the control means includes means for selectively enabling each electromagnet.

12. The magnetically sensitized object detection system of claim 9 further comprising:

second identification card means, disposed in the destination area, for reading data from an identification card;

second magnet means in the destination area for generating a destination area magnetic field, the destination area means including a second plurality of magnets, oriented such that their respective magnetic fields are functionally additively oriented, and a plurality of non-ferrous spacers disposed between the magnets;

the barrier means including means for directing a person to walk in close physical proximity to the second magnet means, whereby the person is exposed to a significant magnetic flux level of the destination area magnetic field;

the passage control means including means for selectively permitting passage from the destination area to the source area responsive to data read from the identification card;

destination area sensor means in the area for sensing a ferrous material after exposure to the destination area magnetic field, the sensor means including means for generating a second area trigger signal representative of the presence of said ferrous material;

means for generating an alert signal responsive to the trigger signal; and means for locking the passage control means responsive to the second area trigger signal.

13. The magnetically sensitized object detection system of claim 9 further comprising a base plate, and wherein the identification card means, the magnet means, the barrier means, the passage control means, and the sensor means are secured to the base plate such that the system is adapted to be pivoted on the base plate whereby the source and destination areas are interchanged.

14. The magnetically sensitized object detection system of claim 8 wherein said passage control means comprises a turnstile.

15. The magnetically sensitized object detection system of claim 8 further comprising:

means for generating a proximity signal representative of passage of a person from the source area to the alternative area; and means for unlocking the passage control means responsive to the proximity signal.

16. A method of regulating passage from a non-secured area and a secured area comprising the steps of:

receiving a machine readable personal identification card, carried by a human cardholder, into a means for reading data stored thereon;

reading personalized cardholder data from the identification card;

exposing the cardholder to a magnetic field, disposed in the non-secured area;

directing the cardholder to walk in the magnetic field, whereby the cardholder is exposed to a significant magnetic flux level thereof;

directing the cardholder to walk to a passage control means adapted to selectively limit passage from the non-secured area to the secured area;

sensing, with a sensor means, a ferrous material after exposure to the magnetic field, the sensor means including means for generating a trigger signal representative of the presence of a ferrous material located on the cardholder;

generating an alert signal responsive to the trigger signal; and selectively locking the passage control means responsive to the trigger signal and data read from the identification card.

17. The method of claim 16 further comprising the step of directing the cardholder to a third area when the passage control means is locked.

18. The method claim 17 further comprising the step of selectively disabling the trigger signal responsive to the cardholder data.

19. The method of claim 18 further comprising the step of selectively removing the magnetic field responsive to the cardholder data.

20. The method of claim 17 further comprising the steps of:

generating a proximity signal representative of passage of a person from the first area to the third area; and unlocking the passage control means responsive to the proximity signal.

* * * * *